United States Patent [19]

Primmer

[11] 4,168,825

[45] Sep. 25, 1979

[54] FRAME HOLDER CLAMP

[76] Inventor: Carl A. Primmer, 804 E. 11th, Vinton, Iowa 52349

[21] Appl. No.: 935,455

[22] Filed: Aug. 21, 1978

[51] Int. Cl.[2] ..... B25B 1/20

[52] U.S. Cl. ..... 269/42; 269/112

[58] Field of Search ..... 269/41-42, 269/111-112

[56] References Cited

U.S. PATENT DOCUMENTS 3,590,458 7/1971 Day ..... 269/112 X

FOREIGN PATENT DOCUMENTS 2151578 4/1973 Fed. Rep. of Germany ..... 269/42
535620 11/1955 Italy ..... 269/112
1447643 8/1976 United Kingdom ..... 269/42

*Primary Examiner*—Robert C. Watson
*Attorney, Agent, or Firm*—Henderson & Sturm

[57] ABSTRACT

A clamping apparatus of type to be used for clamping picture frames or the like is characterized by the speed and simplicity of operation and its ability to quickly accommodate frames of different sizes. Structurally, the preferred embodiment includes a first member, a first arm member pivotally attached to the first member, first corner confinement structure for abutment with a first corner of a frame and pivotally attached to the first arm member, a second arm member pivotally attached to the first member, second corner confinement structure for abutment with a second corner of the frame and pivotally attached to the second arm member, a second member, a third arm member pivotally attached to the third corner confinement structure for abutment with a third corner of the frame and pivotally attached to one end of the third arm member, a fourth arm member pivotally attached to the second member and pivotally attached to one end of the fourth arm member, and a mechanism for adjusting the position of the second member with respect to the first member whereby the first, second, third and fourth corner confinement structures will securely hold all parts of the frame tightly together when the adjusting mechanism is used to move the first and second members towards each other.

12 Claims, 5 Drawing Figures

FRAME HOLDER CLAMP

BACKGROUND OF THE INVENTION

The present invention relates generally to clamping structures and more particularly to a clamping structure for making frames for pictures or the like.

In the field of picture frame construction, one of the primary problems has been the time consuming task of gluing and clamping all of the parts together. Various structures have been devised for the purpose of facilitating this clamping, but all known attempts to solve this problem have resulted in structures which are unduly complicated or still too time consuming.

One approach to this problem is shown in U.S. Pat. No. 171,899 patented in 1876. Another approach to the problem is shown in U.S. Pat. No. 3,590,458, which shows a picture frame holding structure which requires that eight different clamping devices be tightened to hold a frame in place, and loosened when such frame is to be removed from the clamping structure. U.S. Pat. No. 3,015,348 shows still another complex device for solving this problem.

Consequently, it is clear that there is a need for a clamping device which is simple and dependable to use and economical to construct.

SUMMARY OF THE INVENTION

The present invention relates to a clamping apparatus for picture frames or the like including a first member, a first arm member pivotally attached to the first member, first corner confinement structure for abutment with a first corner of a frame and pivotally attached to the first arm member, a second arm member pivotally attached to the first member, second corner confinement structure for abutment with a second corner of the frame and pivotally attached to the second arm member, a third arm member pivotally attached to the second member, third corner confinement structure for abutment with a third corner of the frame and pivotally attached to one end of the third arm member, a fourth arm member pivotally attached to the second member and pivotally attached to one end of the fourth arm member, and a mechanism for adjusting the position of the second member with respect to the first member whereby the first, second, third and fourth corner confinement structures will securely hold all parts of the frame tightly together when the adjusting mechanism is used to move the first and second members towards each other.

An object of the present invention is to provide a clamping apparatus for a picture frame or the like which is simple and dependable to use.

Another object of the invention is to provide a clamping apparatus which facilitates quick clamping and unclamping of a frame.

A further object of the invention is to provide a clamping apparatus which easily accommodates frames of various sizes.

Still another object of the invention is to provide a clamping structure which is economical to manufacture.

Other objects, advantages and novel features of the present invention will become apparent from the following detailed description of the invention when considered in conjunction with the accompanying drawings.

DESCRIPTION OF THE PREFERRED EMBODIMENT

Figure 1:
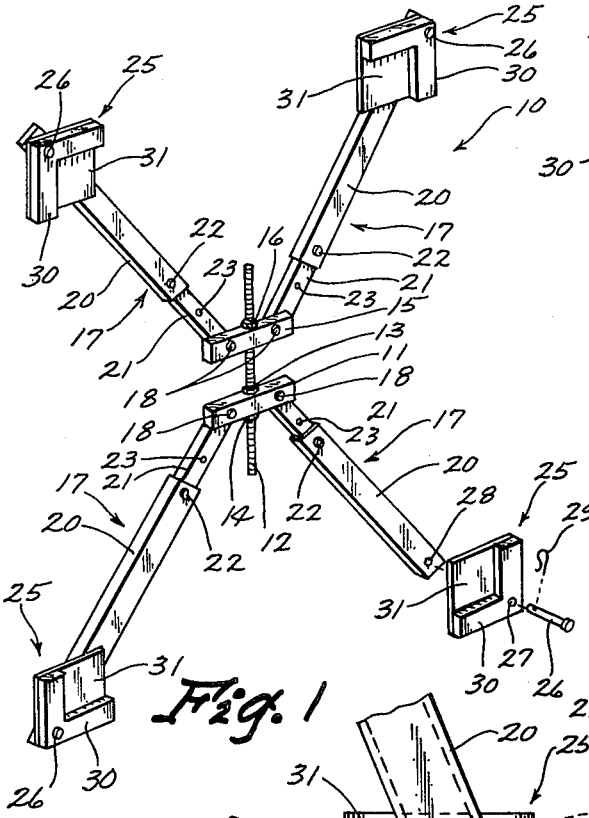
FIG. 1 shows a perspective view of the clamping apparatus of the present invention.

Referring now to the drawings where like reference numerals designate identical or corresponding parts throughout several views, FIG. 1 shows the clamping apparatus 10 constructed in accordance with the present invention.

A first member 11 has a threaded shaft 12 passing through a hole therein and this threaded shaft 12 has a pair of nut members 13 and 14 threadably engaged thereon for providing the proper position of the member 11 with respect to the shaft 12. It will be appreciated that by movement of the nut members 13 and 14, the position of the first member 11 can be adjusted with respect to the shaft 12.

A second member 15 has an opening (not shown) therein which is big enough to slideably receive the shaft 12. A third nut member 16 is threadably disposed on the threaded shaft 12 for a purpose which will be discussed in detail below.

Arm members 17 are pivotally attached to the first and second members 11 and 12 by means of pins 18 which pass through openings within the arm member 17. Cotter keys 19 pass through a small opening in the end of the pins 18 for assuring that these pins 18 remain in place.

Figure 2:
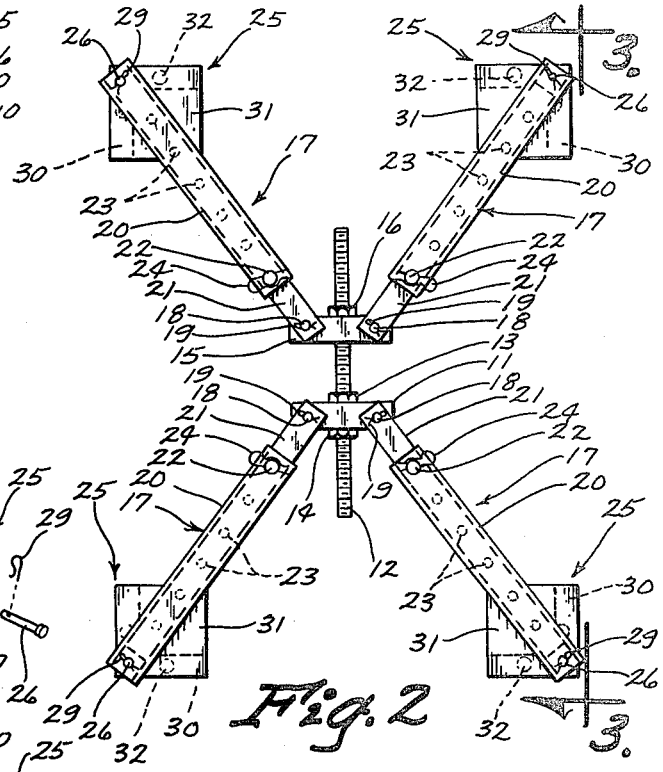
FIG. 2 is a back view of the clamping apparatus of FIG. 1.
Figure 3:
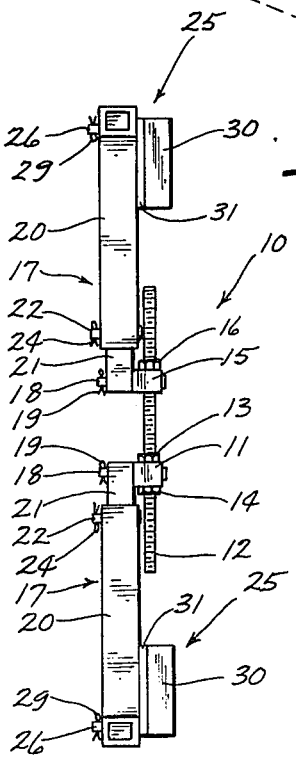
FIG. 3 is a side view of the clamping apparatus taken along line 3—3 of FIG. 2.

Each of the arm members 17 includes a first portion 20 and a second portion 21. The first portion 21 is the portion pivotally attached to one of the arm members 11 and/or 15. The arm portion 21 is slideably received within a hollow arm portion 20. One opening in each of the arm portions 20 is for reception of a pin 22. The arm portions 21 have a series of openings 23 for reception of the pin 22. Accordingly, the length of the arm member 17 can be adjusted by removing the pin 22, by first removing the pin 24 received in one end thereof, then selecting the particular one of the holes 23 in the arm portion 21 depending upon the length desired, and then putting the pins 22 back in place, for example as shown in FIGS. 1–3.

Corner confinement structures 25 are pivotally attached to the end of portion 20 of arm members 17 by means of a pin 26 which is received through an opening 27 in the corner confinement structure 25, and through an opening 28 in the end of the portion 20 of the arm member 17. Once the corner confinement structure 25 is in place and the pin 26 so received within the openings 27 and 28, then another pin 29 is placed through a small opening in the end of the pin 26, as is well known, and is shown in FIGS. 1–3.

Figure 4:
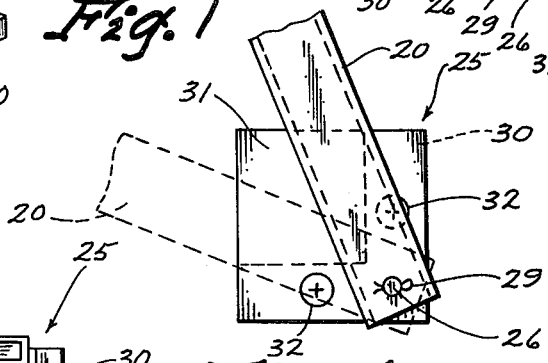
FIG. 4 is an enlarged partial view of the corner confinement structure of the present invention.

The corner confinement structure 25 is preferably molded in one piece from plastic or cast aluminum, but it can also be constructed as shown in the drawings in two pieces 30 and 31. For example as shown in FIG. 4, threaded fasteners 32 would be used to secure the pieces 30 and 31 together.

Figure 5:
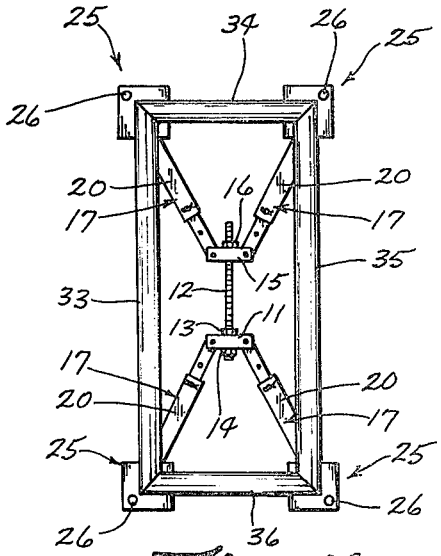
FIG. 5 is a front view of the present invention shown in operation clamping four parts of a frame together.

In operation, the components of a frame to be glued together comprised of members 33, 34, 35 and 36 would be cut, for example, to the shape shown in FIG. 5. The nut member 16 would be loosened or the length of the arm member 17 adjusted so that the corner confinement structures 25 were slightly outwardly beyond the corners of the frame to be formed. The frame members 33–36 would then be placed somewhat loosely within the structure 10, laying the ends thereof on the section 31 of the corner confinement structures 25. Then the nut member 16 would be tightened down so as to move the first and second members 11 and 15, respectively, closer together, thereby forcing the frame members 33–36 to be held tightly together at the corners. It is preferable if the shaft 12 is placed so that it is parallel with the long sides of the frame member, but the invention is not limited to such use.

It can be readily appreciated that virtually any size and shape of frame can be accommodated by this structure. For example, if the frame were to be exactly square instead of rectangular as shown in the frame of FIG. 5, then the same procedure would apply without undue adjusting of the mechanism. If a frame considerably larger than the one shown in FIG. 5 was to be clamped together, then the length of the arm 17 would need to be made longer by utilizing the adjusting structure referred to above. Consequently it can easily be appreciated that the size of a frame to be accommodated by such a structure is only limited by the amount of adjustment provided for within the arm member 17 and shaft 12. As a practical matter, the size of such apparatus 10 and of the adjusting mechanism therein would be constructed in accordance with the needs of the user. For example, if someone is to be clamping picture frames, then a relatively small clamping apparatus 10 would be constructed. However, if it were to be used for clamping door frames or the like together, then a larger structure would be used which might not be practical for making very small picture frames. This is not to say that a structure could not be constructed which would be versatile enough to accommodate extremely small and extremely large applications.

Obviously many modifications and variations of the present invention are possible in light of the above teachings. It is therefore to be understood that, within the scope of the appended claims, the invention may be practiced otherwise than as specifically described.

I claim:

1. Clamping apparatus comprising:

a first member;

a first arm member pivotally attached to said first member;

first corner confinement means for abutment with a first corner of a frame;

first means for pivotally affixing said first corner confinement means to one end of said first arm member;

a second arm member pivotally attached to said first member;

second corner confinement means for abutment with a second corner of said frame;

second means for pivotally affixing said second corner confinement means to one end of said second arm member;

a second member;

a third arm member pivotally attached to said second member;

third corner confinement means for abutment with a third corner of said frame;

third means for pivotally affixing said third corner confinement means to one end of said third arm member;

a fourth arm member pivotally attached to said second member;

fourth corner confinement means for abutment with a fourth corner of said frame;

fourth means for pivotally affixing said fourth corner confinement means to one end of said fourth arm member;

means for adjusting the position of said second member with respect to said first member over a range of adjustment whereby said first, second, third and fourth corner confinement means will securely hold all parts of said frame tightly together when said adjusting means is used to move said first and second members towards each other; and means for selectively varying the length of each of said arm members in order to accomodate the clamping of different sizes of frames.

2. Clamping apparatus as defined in claim 1 wherein said adjusting means comprises a threaded member secured to said first member and slideably extending through an opening in said second member, and threaded nut means threadably engaging the threads on said threaded member whereby rotation of said nut means in one direction causes said first and second members to be forced closer together and rotation of said nut means in the other direction allows said first and second members to move farther apart with respect to each other.

3. Clamping apparatus as defined in claim 1 wherein said varying means includes telescoping arm members and pin and hole means for selectively holding said telescoping members fixed with respect to each other.

4. Clamping apparatus as defined in claim 1 wherein each of said corner confinement means comprises an L-shaped member for receiving a corner of the frame and plate means secured to one side of said L-shaped member for substantially preventing twisting of the frame while it is being clamped.

5. The clamping apparatus as defined in claim 1 wherein said adjusting means includes a means for varying said range of adjustment.

6. The clamping apparatus as defined in claim 2 wherein said adjusting means includes a means for varying said range of adjustment.

7. The clamping apparatus of claim 6 wherein said range varying means comprises a means for varying the position of said first member with respect to said threaded member.

8. The clamping apparatus of claim 7 wherein said first member is secured to said threaded member by means of a pair of nuts said nuts being threadably engaged with said threaded member and securing said first member between them.

9. Clamping apparatus comprising:

a first member;

a first arm member pivotally attached to said first member;

first corner confinement means for abutment with a first corner of a frame;

first means for pivotally affixing said first corner confinement means to one end of said first arm member;

a second arm member pivotally attached to said first member;

second corner confinement means for abutment with a second corner of said frame;

second means for pivotally affixing said second corner confinement means to one end of said second arm member;

a second member;

a third arm member pivotally attached to said second member;

third corner confinement means for abutment with a third corner of said frame;

third means for pivotally affixing said third corner confinement means to one end of said third arm member; p1 a fourth arm member pivotally attached to said second member;

fourth corner confinement means for abutment with a fourth corner of said frame;

fourth means for pivotally affixing said fourth corner confinement means to one end of said fourth arm member;

means for adjusting the position of said second member with respect to said first member over a range of adjustment whereby said first, second, third and fourth corner confinement means will securely hold all parts of said frame tightly together when said adjusting means is used to move said first and second members towards each other; and means for varying said range of adjustment.

10. Clamping apparatus as defined in claim 9 wherein said adjusting means comprises a threaded member secured to said first member and slideably extending through an opening in said second member, and threaded nut means threadably engaging the threads on said threaded member whereby rotation of said nut means in one direction causes said first and second members to be forced closer together and rotation of said nut means in the other direction allows said first and second members to move farther apart with respect to each other.

11. The clamping apparatus of claim 10 wherein said range varying means comprises a means for varying the position of said first member with respect to said threaded member.

12. The clamping apparatus of claim 11 wherein said first member is secured to said threaded member by means of a pair of nuts said nuts being threadably engaged with said threaded member and securing said first member between them.

* * * * *